United States Patent [19]

Innacelli

[11] 4,373,539

[45] Feb. 15, 1983

[54] TOBACCO SMOKE FILTER

[76] Inventor: Frank L. Innacelli, 25 Mori Pl., Red Bank, N.J. 07701

[21] Appl. No.: 305,719

[22] Filed: Sep. 25, 1981

[51] Int. Cl.[3] ..... A24D 3/00; A24D 3/02; A24D 3/04

[52] U.S. Cl. ..... 131/209; 131/331

[58] Field of Search ..... 131/209, 331, 337, 339, 131/340, 341, 342, 343, 344, 345

[56] References Cited

U.S. PATENT DOCUMENTS

| | | | |
|---|---|---|---|
| 2,462,446 | 2/1949 | Wellborn | 131/339 |
| 2,848,000 | 8/1958 | Herbster | 131/209 |
| 3,320,960 | 5/1967 | Molins | 131/339 |
| 3,355,317 | 11/1967 | Keith et al. | 131/342 |

FOREIGN PATENT DOCUMENTS

| | | | |
|---|---|---|---|
| 1027072 | 2/1953 | France | 131/209 |
| 823690 | 11/1959 | United Kingdom | 131/342 |

*Primary Examiner*—V. Millin

*Attorney, Agent, or Firm*—Watson, Cole, Grindle & Watson

[57] ABSTRACT

The filtration route of tobacco smoke is increased by coiling a length of plastic tube filled with activated charcoal to form a coiled configuration similar to a coiled spring and placed between the conventional cellulose filter and the tobacco charge by using cigarette wrapping paper to form an assembled cigarette. While the tobacco charge remains close to the cellulose filter, the smoke from the burning tobacco charge starts its filtering route much farther away from the cellulose filter and as the smoke passes through the longer filtration route it is cooled by ambient air and completely filtered of all harmful tars. The coil configuration may also be constructed by casting the activated charcoal configuration as a core by utilizing a mold fabricated in two half sections. The coiled core is sprayed with a sealant to render it impervious to liquids and air and then inserted into a section of thin wall tube the length of the coiled core to protect the core from damage in handling. The section is then joined to the cellulose filter and tobacco charge. Another means of constructing the coiled configuration is to tap a length of lightweight plastic rod with a diameter the same as the diameter of a conventional cigarette with a "corkscrew" type thread through the longitudinal axis of the rod thus forming an elongated filtration route. The threaded coiled rod is filled with activated charcoal and then joined with the cellulose filter and the tobacco charge to form an assembled cigarette. A chemically treated wick to remove harmful tars may be used in lieu of activated charcoal when utilizing the plastic tube for the coiled configuration.

15 Claims, 21 Drawing Figures

TOBACCO SMOKE FILTER

BACKGROUND OF THE INVENTION

1. Field of the Invention

This invention relates to a tobacco and smoke filter that may be used in cooperation with the existing conventional cellulose filter or may be used as a unit attached only to the tobacco charge. The term "tobacco charge" as hereinafter used is construed to mean the tobacco portion of the cigarette or cigar.

2. Prior Art

The U.S. Surgeon General has determined that cigarette smoking is dangerous to one's health. The foregoing warning is printed on each package of cigarettes and other tobacco products used for smoking. The warning is also contained in advertisements for cigarettes, cigars and pipe tobacco.

In order to separate the burning tobacco charge from the cellulose filter it would be necessary to utilize a filter several times the length of the tobacco charge or approximately six (6) inches long. The length of the filter may be shorter or longer depending upon the required length of the filtration route of the smoke. Needless to say such an arrangement would be impractical and cumbersome. To package cigarettes of such length would be costly and would require a pack size that would be difficult to carry and hard to handle.

There have been many attempts to devise a tobacco smoke filter that will remove all harmful tars from the burning tobacco charge and thus far the introduction of such a highly efficient filter has not been made public. Many renown researchers in conducting the harmful effects of smoking cigarettes and other tobacco products have said that the closeness of the burning tobacco charge to the smoker's mouth causes the smoker to inhale hot and irritating smoke thus seriously damaging the upper respiratory system of the smoker.

SUMMARY OF THE INVENTION

An object of the invention is to provide a tobacco and smoke filter which separates the tobacco charge and the conventional cellulose filter by approximately one and one-quarter inches, the length of which may be reduced or increased contingent upon the overall length of the required filtration route, that requires the smoke generated by the burning of the cigarette charge to flow through the filtration route of the filter which when uncoiled is approximately six (6) inches in length.

An object of the invention is to provide a novel and improved smoke filter means and combination of cigarette and filter means which is highly effective to a maximum degree in eliminating noxious tars and other harmful substances created by the burning tobacco charge of the cigarette or tobacco smoke prior to the harmful tars and other noxious substances reaching the cellulose filter and thence to the smoker's mouth.

Another object of the invention is to provide an improved cigarette filter and improved smoke filter unit which is constituted and constructed to require the smoke to travel a greater distance through the filtration route of the filter prior to the smoke entering the smoker's mouth for inhalation than the much shorter distance required by the smoke to travel through the filtration route of the cellulose filter. The greater the distance the smoke passes through the filtration route of the invention the more complete the filtering out of the noxious and harmful substances takes place.

A further object of the invention is to provide an improved and highly efficient filter in accordance with the foregoing which is so constituted and constructed that it is positioned between the present cellulose filter and the tobacco charge on their longitudinal axes joined together by the cellulose filter wrapper and the tobacco charge wrapper forming a single unitized cigarette.

Another object of the invention is to provide an improved cigarette filter and improved smoke filter unit which causes the smoke generated by the burning tobacco charge to travel a greater distance from the tobacco charge portion of the cigarette to and through the cellulose filter thus filtering out all noxious tars and cooling the smoke before being drawn into the mouth of the smoker.

A further object of the invention is to provide a tobacco smoke filter that does not employ the use of chemicals, fibers or other additives which in themselves may be harmful in nature and injurious to the smoker.

A still further object of the present invention is to provide a filter which contains a sufficient amount of activated charcoal to efficiently remove all harmful tars from the smoke before reaching the mouth of the smoker.

An additional object of the present invention is to provide a cigarette tobacco filter in several variations which employ the basic principle of utilizing an activated charcoal filled plastic tube approximately six (6) inches in length formed into a coiled configuration which is simple to construct, highly efficient in the removal of all harmful tars from the burning tobacco, and which is commercially feasible both from a manufacturing and sales point of view.

Another additional object of the invention is to provide an improved and highly efficient smoke filter which is so constructed that one opposed end of the filter is formed into a mouthpiece and the other opposed end is formed into a funnel shape with flange edge, the diameter of which is not larger than the diameter of the tobacco charge, used as a means for joining the filter with the tobacco charge so that the tobacco wrapper bonds the filter and the tobacco charge as a unit. The filter formed into a mouthpiece, while not delineated to employ the use of the conventional cellulose filter, is positioned between the coiled configuration and the stem of the mouthpiece so that the smoke drawn from the burning tobacco charge travels through the coiled configuration, the cellulose filter and then through the stem of the mouthpiece. Although the invention may be used without the conventional cellulose filter the use of the filter will give the appearance of a conventional cigarette. The use of the cellulose filter does not necessarily improve the filtration process of the invention.

And yet a further object of the invention is to provide a novel and improved tobacco smoke filter means, and combination of cigarette and filter means which separates, in its uncoiled state, the conventional cellulose filter and tobacco charge of the cigarette by upward to six (6) inches by not actually creating a separation between the cellulose filter and the tobacco charge of the cigarette by more than one and one quarter inches. The length of such separation is determined by the length of the filtration route of the smoke necessary to remove noxious and harmful tars and other substances injurious to health.

The filter is constructed by employing the use of a pliable and bendable thin wall plastic tube or a tube manufactured of other light gage material such as aluminum foil filled with activated charcoal and formed into a coil similar to the coiled construction of a spring. Thus by coiling the plastic tube approximately six (6) inches in length the distance that separates the cellulose filter and the tobacco charge is reduced to approximately one and one quarter inches. However, the length of the filtration route remains unchanged in length. It may be necessary to use a tube of a larger diameter so as to contain a greater amount of activated charcoal. Therefore, the coiling of the plastic tube will result in the coiled configuration having a diameter larger than the diameter of the tobacco charge of the conventional cigarette. This condition may pose a packaging problem of the cigarettes embodying the improved filter. However, packaging engineers possess the expertise to surmount the problem.

The opposed ends of the tube are formed into funnel shape prior to the coiling of the plastic tube. The funnel shape ends of the plastic tube are one of the critical features of the invention in that the mouth of the funnel has the same outside diameter as the diameters of the cellulose filter and the tobacco charge of a conventional cigarette thus facilitating the joining of the cellulose filter, the coiled configuration of the invention and the tobacco charge by wrapping the aforementioned sections with cigarette paper.

The funnel shape ends of the filter which contain activated charcoal permit the collection and dispersal of smoke drawn from the burning tobacco charge as the smoke is drawn through the coiled tube to the opposed funnel shape end and thence through the cellulose filter into the mouth of the smoker.

The plastic tube may be filled with compressed activated charcoal after the funnel shape ends have been formed or the tube may be filled after the coiling of the tube. This is a manufacturing process which will be resolved after experimenting with various methods of coiling the plastic tube.

The foregoing delineates the construction of the filter as a unit. However, the filter can be constructed in three separate sections comprised of a coiled tube and two (2) funnel shape caps one of which is joined to the cellulose filter and the other cap is joined to the tobacco charge. The aperture of the funnel shape cap, centrally located, has an inside diameter the same as the outside diameter of the opposed ends of the coiled tube which are inserted into the caps of the cellulose filter and tobacco charge, respectively, to form an assembled cigarette.

Another variation of the invention is to form one opposed end of the coiled tube into a mouthpiece thus eliminating the need of the cellulose filter and to form the other end into a funnel shape which is joined to the tobacco charge by wrapping the funnel shape end and the tobacco charge with cigarette wrapper to form an assembled cigarette. As stated heretofore, the cellulose filter does not necessarily improve the filtration of the smoke. However, its use in cooperation with the invention adds to the cosmetic appearance of the cigarette as a complete unit and may be a sales promotion feature.

In order to prevent the hot smoke from reaching the smoker's mouth the new and novel invention employs the use of a length of plastic tubing approximately six (6) inches in length formed into a coiled configuration with funnel shape opposed ends and filled with activated charcoal. The opposed funnel shape ends of the coiled configuration are attached to the cellulose filter and tobacco charge. By coiling the tube the filtration route remains unchanged in length thus causing the hot smoke to travel a distance of approximately six (6) inches before entering the mouth of the smoker. However, the cellulose filter and tobacco charge are separated only by the length of the improved filter means which is approximately one and one-quarter inch in length. The hot smoke is also cooled by ambient air as the smoke is drawn from the tobacco charge through the coiled configuration of the tube and through the cellulose filter before the smoke enters the mouth of the smoker.

The design variations of the invention include a plastic tube approximately six (6) inches in length formed into a coiled configuration with opposed funnel shape ends as a unit, a filter comprised of three (3) parts, namely, two (2) funnel shape caps and a plastic tube approximately six (6) inches in length formed into a coiled configuration without the funnel shape caps, a plastic tube approximately six (6) inches in length formed into a coiled configuration with one opposed funnel shape end and the other opposed end formed into a mouthpiece, and an activated charcoal coiled configuration formed into a solid core sprayed with a sealing agent so as to form a protective covering for the activated charcoal core and to render the core impervious to air or liquids. In essence the sealing agent creates a tube. The core is then inserted into a plastic cylinder.

Another feature of the invention is to construct a filtration route by tapping a "corkscrew" type thread in a section of lightweight plastic rod approximately one and one-quarter inch in length with an outside diameter the same as the outside diameter of a conventional cigarette. The opposed ends of the section are formed into a concave funnel shape so that the smoke from the tobacco charge at the inlet end of the filter is more readily dispersed through the filtration route and through the opposed funnel shape or the outlet end and thence through the cellulose filter. The "corkscrew" type threaded section of the plastic rod is then filled with compressed activated charcoal thus forming a coiled core. In essence the "corkscrew" type threaded section of the plastic rod becomes a mold. To facilitate the casting of the coiled figuration of the activated charcoal core the mold is cut in half on its longitudinal axis and each half is filled with compressed activated charcoal. The half sections filled with activated charcoal are cemented together to form a solid section, the inlet end of which is attached to the tobacco charge by wrapping cigarette paper around the inlet end of the section and the tobacco charge and by wrapping the cigarette paper around the outlet end of the section and the cellulose filter, thus forming an assembled cigarette.

The improved filter may be constructed in three (3) separate sections comprised of two (2) funnel shape caps and one coiled configured tube. One cap is attached to the cellulose filter and the other cap is attached to the tobacco charge. The opposed ends of the coiled configuration are inserted in the apertures of cellulose filter and the tobacco charge to form an assembled cigarette.

The coiled configuration can be formed with one end as a mouthpiece and the opposed end with a funnel shape with flange so as to facilitate the joining of the tobacco charge to the funnel shape end by utilizing the cigarette paper wrapper to bond the filter to the tobacco charge.

Another method of constructing the coiled configuration is to use a mold for casting the activated charcoal coiled configuration as a core. The core is either sprayed or dipped in a sealant so as to form a impervious jacket around the coiled configuration and thus serves the same purpose of the plastic tube. The coiled core is then inserted into a length of thin wall plastic tube to protect the core from breakage prior to being joined to the cellulose filter and the tobacco charge. The two halves of the mold used to cast the core may be cemented together and filled with compressed activated charcoal thus forming the filter unit that is ready for being attached to the cellulose filter and the tobacco charge.

An additional method in constructing the coiled configuration is by tapping a length of lightweight plastic approximately one and one-quarter inch in length with a diameter the same as a conventional cigarette with a "corkscrew" type thread on its longitudinal axis thus forming a filtration route approximately six (6) inches long. The opposed ends of the tapped section are joined to the cellulose filter and the tobacco charge.

From the foregoing it is clear that the coiling of a length of plastic tube to form a coiled configuration and the construction of the coiled configuration by employing other methods herein aforementioned will create a filtration route of approximately six (6) inches and separate the cellulose filter and tobacco charge by approximately one and one-quarter inch.

BRIEF DESCRIPTION OF THE DRAWINGS

The above objects, advantages and features of the invention are readily apparent from the following description of preferred embodiments of the best mode of carrying out the invention when taken in conjunction with the drawings, wherein.

DETAILED DESCRIPTION

Figures 1, 2, 3, 4, 5, 6, 7, 8, 9:
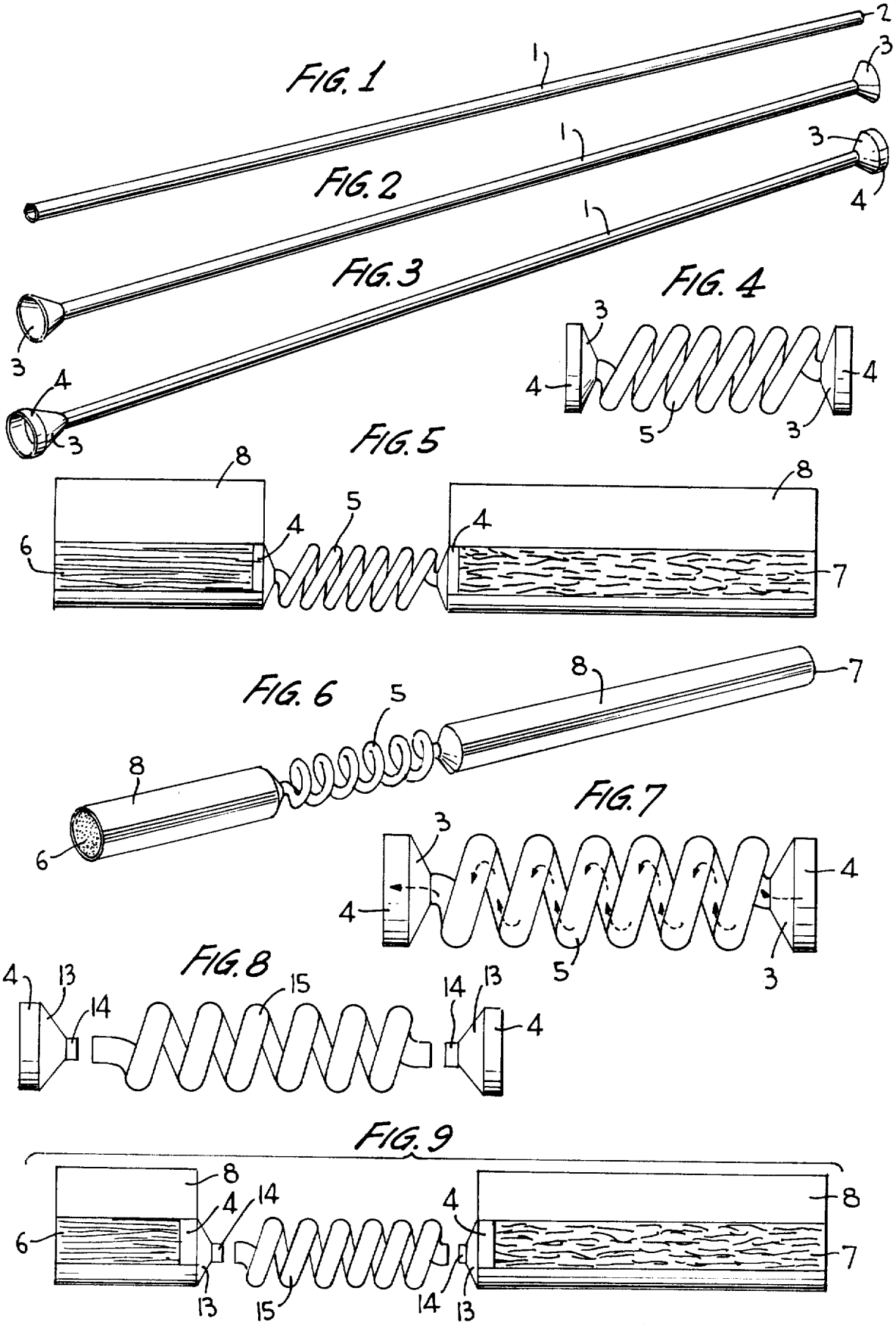
FIG. 1 is an axial view, slightly enlarged, of the raw thin wall plastic tubing or of similar material having pliable and bendable properties without rupturing the wall of the tubing during the coiling operation.
FIG. 2 is an axial view of the plastic tube flared at the opposed ends to form a funnel shape sufficiently adequate in diameter to permit the creation of flanges.
FIG. 3 is an axial view of the plastic tube with opposed funnel shape ends with flanges.
FIG. 4 is a plan view of the plastic tube formed in a coiled shape with opposed funnel shape ends with flanges.
FIG. 5 is a plan view of the cellulose filter, the invention and the tobacco charge with cigarette wrapper partially unrolled which exposes the flanges of the funnel shape opposed ends.
FIG. 6 is a perspective view of the conventional cellulose filter and tobacco charge joined to the coiled filter with the coiling slightly expanded to show the construction of the invention.
FIG. 7 is a greatly enlarged plan view of the coiled configuration which shows the funnel shape flanged opposed ends and the coiling of the configuration expanded to show its construction. The superimposed broken arrow shows the filtration route of the smoke.
FIG. 8 is a plan view of the invention comprised of two (2) funnel caps with flanges and the spiral tube with the opposed ends centrally positioned on their longitudinal axes.
FIG. 9 is an exploded plan view of the cigarette which shows the funnel shape cap with flange as an integral part of the cellulose filter and the funnel shape cap with flange as an integral part of the tobacco charge with the wrappers of the cellulose filter and tobacco charge partially unrolled to expose the flanges of the funnel shape caps.

FIG. 1 is a perspective view of a straight length of thin wall plastic tube 1 approximately six (6) inches in length with an inside diameter 2 of approximately one-eighth inch. FIG. 2 is a perspective view of plastic tube 1 with formed funnel shape 3 opposed ends. FIG. 3 is a perspective view of plastic tube 1 with opposed funnel shape 3 ends with flanges 4. After forming the funnel shape 3 opposed ends with flanges 4 the plastic tube 1 is filled with activated charcoal prior to forming the coiled configuration 5 as shown in FIG. 4.

FIG. 4 is an axial view of the coiled configuration 5 of the invention with funnel shape 3 opposed ends with flanges 4. The funnel shape can be constructed as a concave cap or collar thus eliminating the need for flanges since a portion of the collar or cap can serve the same function as hereinafter described for the flanges 4 of the funnel shape 3.

FIG. 5 is an axial sectional view of the cigarette assembled with the cellulose filter 6, the coiled configuration 5 of the invention, and the tobacco charge 7 with cigarette wrapper 8 partially unrolled so as to expose the flanges 4 of the funnel shape 3 opposed ends of the coiled configuration 5. It is apparent that the smoke drawn from the burning tobacco charge 7 must follow the filtration route of the coiled configuration 5 before the smoke reaches the cellulose filter 6 and thence into the mouth of the smoker. As the smoke passes through the long filtration route all the harmful tars, nicotine and other injurious substances are filtered before the smoke enters the mouth of the smoker.

FIG. 6 is a perspective view of the assembled cigarette which shows the coiled configuration 5 joined to the cellulose filter 6 and joined to the tobacco charge 7. The coiling of configuration 5 is slightly expanded to show the construction of the invention. However, in its final commercial form the coiling will not be closed tightly since a small separation between turns of the coil will allow ambient air to circulate through the coiling thus cooling the hot smoke before it enters the mouth of the smoker.

FIG. 7 is an enlarged axial view of the improved filter which shows the coiled configuration 5 and the funnel shape 3 opposed ends with flanges 4. The superimposed broken arrow shows the filtration route of the smoke. As stated in the description of FIG. 6 the expanded coiling permits the circulation of air. The amount of the expansion of the coiling can be established during the production of the prototype of the improved filter.

FIG. 8 shows an exploded axial view of the invention which is constructed as three (3) separate parts comprised of two (2) funnel shape caps 13 with flanges 14 and coiled tube 15.

FIG. 9 is an exploded axial view of the cigarette which shows the cellulose filter 5 with funnel shape cap 13 and the tobacco charge 6 with funnel shape cap 13 prior to being joined to the coiled tube 15 to form a unitized cigarette. The cellulose filter 5 and the tobacco charge 6 are joined with the coiled tube 15 and held together by friction. Heat is applied to the funnel shape caps 13 where the opposed ends 16 of the coiled configuration 15 are inserted in the apertures 13' of the funnel shape cap 13. The edge of aperture 13' is rounded rather than finished with a raw edge so as to facilitate the insertion of the opposed ends 16 of coiled configuration 15 into apertures 13' of funnel shape cap 13.

Figure 10:
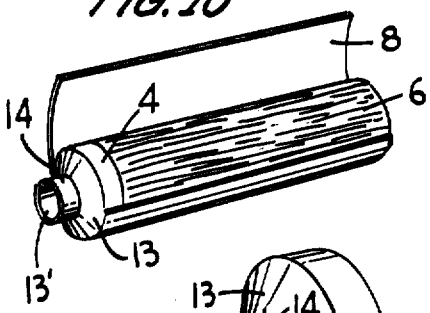
FIG. 10 is a perspective view of the cellulose filter of the cigarette with the funnel shape cap joined thereto thus becoming an integral part of the tobacco charge with the wrapper partially unrolled so as to expose the flange of the funnel shape cap.

FIG. 10 is a perspective view of cellulose filter 6 with cap 13 joined thereto with the cigarette wrapper partially unrolled so as to expose flange 4. The funnel shape cap 13 is held firmly to the cellulose filter 6 since wrapper 8 is adhered to flange 4 of cap 13 when wrapper 8 is completely wrapped around cellulose filter 6.

Figure 11:
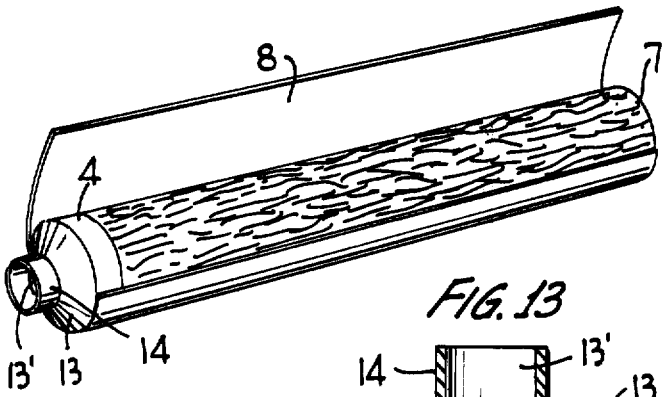
FIG. 11 is a perspective view of tobacco charge 7 with cap 13 joined thereto with the cigarette wrapper partially unrolled so as to expose flange 4. The funnel shape cap 13 is held firmly to the tobacco charge 7 since wrapper 8 is completely wrapped around flange 4 of cap 13 and around tobacco charge 7 simultaneously.

FIG. 11 is a perspective view of tobacco charge 7 with cap 13 joined thereto with the cigarette wrapper partially unrolled so as to expose flange 4. The funnel shape cap 13 is held firmly to the tobacco charge 7 since wrapper 8 is adhered to flange 4 of cap 13 when wrapper 8 is completely wrapped around tobacco charge 7.

Figure 12:
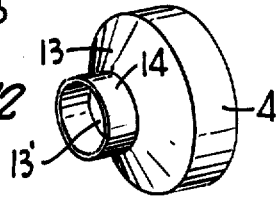
FIG. 12 shows a perspective view of the funnel shape cap 13 and aperture 13' thereof with flange 4 and collar 14 sufficient in length to engage the opposed ends 16 of the coiled configuration 15.
Figure 13:
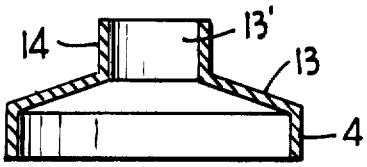
FIG. 13 is a vertical view of the funnel shape cap 13 with flange 4, collar 14 and aperture 13' thereof, which shows the rounded edge of collar 14 of aperture 13' the drawing for which is cut in half to show the rounded edge of collar 14.

FIG. 12 shows a perspective view of funnel shape cap 13 and aperture 13' thereof with flange 4 and collar 14 sufficient in length to engage the opposed ends 16 of spiral configuration 15. FIG. 13 is a vertical view of the funnel shape cap 13 with flange 4, collar 14 and aperture 13' thereof, which shows the rounded edge of collar 14. The drawing is partially cut in half to show the rounded edge of aperture 13' of the collar 14.

Figure 14:
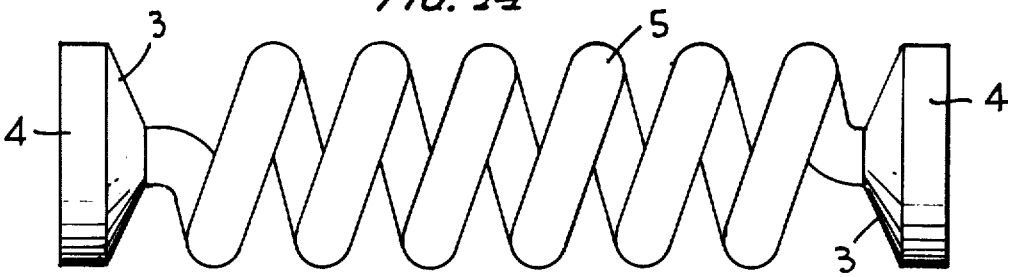
FIG. 14 is an axial view of the coiled configuration 5 with funnel shape 3 opposed ends with flanges 4 cast into a solid core of activated charcoal. The core is fixed with a sealant so as to render the core impervious to liquids and air and for structural strength.

FIG. 14 is an axial view of the coiled configuration 5 with funnel shaped opposed ends 3 with flanges 4 cast into a solid core of activated charcoal. The core is fixed with a sealing agent so as to render the core impervious to other liquids and for structural strength.

Figure 15:
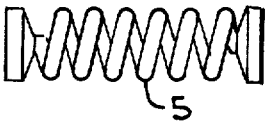
FIG. 15 is an axial view of the coiled configured activated charcoal core 5 coated with a lightweight, quick-drying plastic sealant thus forming and having the same function of plastic tube 1, 2, and 3, aforementioned.

FIG. 15 is an axial view of the coiled configured activated charcoal core 5 embodied in a lightweight, quick-drying plastic liquid and thus forming the plastic tube. The opposed ends of the capsule are not coated with the sealing agent mentioned in the description of FIG. 14 nor are the opposed ends of the capsule sealed during the embodiment of the core in plastic liquid. The ends of the core must not be made impervious so as to allow complete filtration of the smoke.

Figure 16:
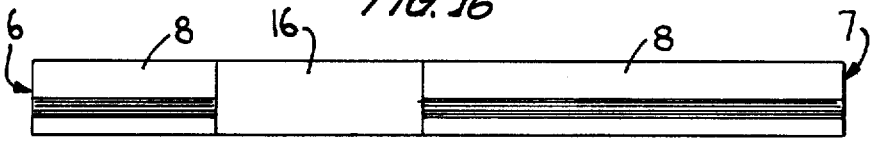
FIG. 16 shows the encapsulated activated charcoal core 15 (not visible through a section 16 of hollow tube) joined to cellulose filter 6 and tobacco charge 7 to form an assembled cigarette.

FIG. 16 shows the capsule 16 with coiled configured activated charcoal core 5 with funnel shaped opposed ends 3 embodied in capsule 16 and joined to cellulose filter 6 and joined to tobacco charge 7 to form a unitized cigarette.

Figure 17:
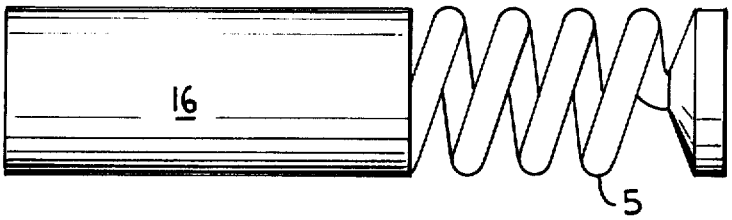
FIG. 17 shows the coiled configured activated charcoal core 5 with funnel shape end 3 and flange 4 thereof partially inserted into section of the hollow tube 16 the length of which is no longer than the coil configured activated charcoal core 5. The section of the tube 16 protects the core from damage during the manufacture of the filter and during the joining of assembly 16 to the cellulose filter 6 and the tobacco charge 7.

FIG. 17 shows the coil configured activated charcoal core 5 with funnel shape end 3 and flange 4 thereof partially inserted in section of hollow tube 16 the length of which is no longer than the coil configured activated charcoal core 5. The section of the tube 16 protects the core 5 from damage during the manufacture of the filter and during the joining of assembly 16 to the cellulose filter 6 and the tobacco charge 7.

Figure 18:
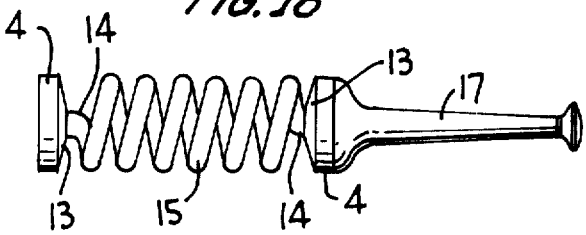
FIG. 18 shows the coiled configuration 15 with funnel shape end 13 and flange 4 thereof formed as an integral part of the coiled configuration 15 and the opposed end of the coiled configuration 15 joined to mouthpiece 17. The assembly as shown in FIG. 18 is joined to the tobacco charge 7 as stated in the preceding descriptions of the drawings.

FIG. 18 shows the coiled configuration 15 with funnel shape end 13 and flanges 4 thereof formed as an integral part of the coiled configuration 15 and the opposed end of the coiled configuration 15 joined with mouthpiece 17. The assembly as shown in FIG. 18 is joined to the tobacco charge 7 as stated in the preceding descriptions of the drawings.

Figure 19:
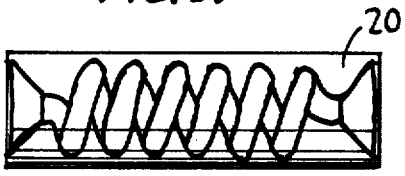
FIG. 19 shows one half of the mold used in the casting of the activated charcoal into a coil configuration 5 core and after removing the core from the mold for spraying with a sealant the two (2) halves of the mold are cemented together and filled with compressed activated charcoal to form sections as shown in FIGS. 14, 15 and 17.
Figure 20:
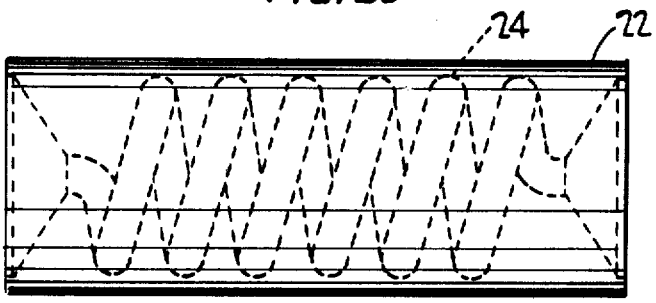
FIG. 20 shows a section of lightweight plastic rod with a diameter the same as the diameters of the cellulose filter 6 and tobacco charge 7 with a "corkscrew" type thread tapped through the section of the plastic rod on its longitudinal axis thus forming a filtration route of approximately six (6) inches in length. The tapped section is then filled with compressed activated charcoal and joined to the cellulose filter 6 and tobacco 7 to form an assembled cigarette.
Figure 21:
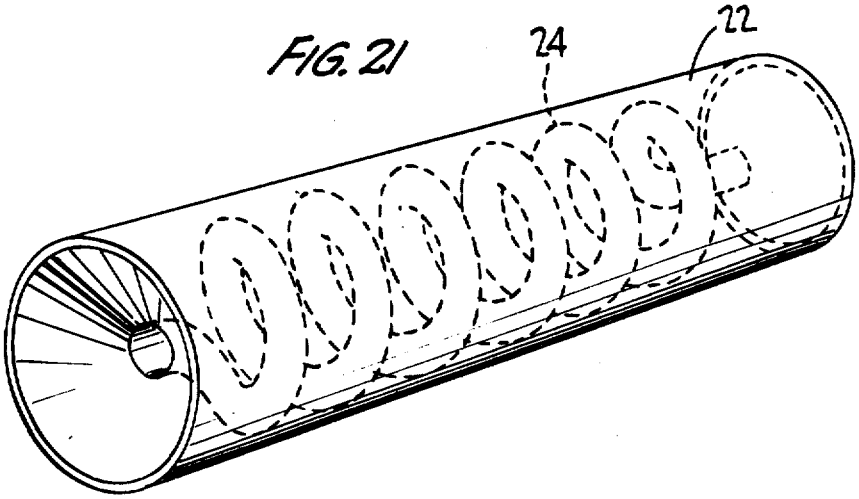
FIG. 21 is a perspective view of the section of the filter described in preceding FIG. 20.

FIGS. 19 and 20 show a one half section of the mold used in casting the activated charcoal filter in the coil configuration 5 core. The opposed half section of the mold is not shown. After removing the activated charcoal core from the mold the two (2) half sections are cemented together to form a one piece filter element as shown in FIG. 21. The element is filled with activated charcoal thus completing the coil configuration as shown in FIG. 21. After removing the charcoal core it is sprayed with a sealant to form a protective coating for the core and in essence creating a tube. The mold thus performs two (2) functions as set forth above.

FIG. 21 shows another method of fabricating the filter. A section of lightweight plastic rod having a diameter the same as the diameters of the cellulose filter and tobacco charge with a "corkscrew" type thread tapped through the plastic rod on its longitudinal axis thus forming a filtration route of approximately six (6) inches, for example. The length of the plastic rod being no longer than coil configuration 5 shown in FIG. 4. The threaded section is then filled with activated charcoal and joined with cellulose filter 6 and tobacco charge 7 to form an assembled cigarette.

It will now be understood from the foregoing that I have provided a new and novel cigarette and tobacco smoke filtering unit which is especially effective in removing harmful tars and other injurious substances from the smoke generated by the burning tobacco charge, which is easy to fabricate and being small and compact may be readily incorporated and used in cooperation with the existing conventional cellulose filter by placing the improved filter between the cellulose filter and tobacco charge and by joining the improved filter to the components of the cigarette by wrapping the cigarette paper around the cellulose filter and the tobacco charge as a unit to form an assembled cigarette.

It is to be understood that although the above preferred embodiments have often been described using an uncoiled filter length of approximately six inches and a coiled filter length of approximately one and one-quarter inches, the invention may be practiced with any uncoiled length and coiled length of filter depending upon the filtering requirements to be satisfied which may dictate shorter or lengthier filter segments in either or both the coiled and uncoiled segments. Moreover, the pitch of the coiled tube may be varied to produce tighter or looser coil configurations than those illustrated and described herein in order to meet various filter design criteria.

It is, therefore, desired that the present invention not be limited to the embodiments specifically described, but that it include all such modifications and variations as would be obvious to those of ordinary skill in this art. The scope of my invention should be determined by the equivalence of the various terms as recited in the following annexed claims.

I claim :

1. A smoking device comprising a means to hold a tobacco charge having a smoke outlet end, a conventional cellulose filter having an inlet end and a coiled helical tube filled with compressed carbon having an inlet and outlet end portion, said coiled tube placed between said filter and said means to hold the tobacco charge wherein said inlet portion of the coil is directly connected to the outlet of the means to hold the tobacco charge and the outlet portion of the coil is connected to said filter means whereby any tobacco smoke leaving the outlet end of the tobacco charge holding means passes directly into the inlet portion of said coil.

2. The smoking device as claimed in claim 1, wherein the opposed ends of said tube are formed into funnel shape or concave caps with flanges.

3. The smoking device as claimed in claim 2, wherein the flanges of the funnel shape opposed ends of the coil configuration are structurally designed to permit the attachment of the conventional cellulose filter and the tobacco charge thereto on the longitudinal axes thereof by the cigarette paper wrapping around the cellulose filter and the tobacco charge.

4. The smoking device as claimed in claim 3, wherein the funnel shape cap ends have an aperture centrally located therein for receiving the respective opposed ends of the conventional filter and the tobacco charge, respectively.

5. The smoking device as claimed in claim 1 wherein said tube in its coiled configuration is approximately one and one-quarter inch long and is wound from an approximately six inch length of plastic tube.

6. The smoking device as claimed in claim 1, in which the coiled configuration of the tube causes the hot tobacco smoke to be cooled by ambient air as the smoke passes through the tube.

7. The smoking device as claimed in claim 1, further comprising a funnel shape cap attached to an end of the cellulose filter and another funnel shape cap attached to an end of the tobacco charge and said inlet portion of the coil is inserted in the aperture of the funnel shape cap attached to the tobacco charge and wherein the outlet portion of the coil is inserted in the aperture of the funnel shape cap attached to the cellulose filter.

8. A smoking device comprising a means to hold a tobacco charge having a smoke outlet end, a filter element with a coiled helical tube passage filled with compressed carbon having an inlet and an outlet end portion with said outlet portion being formed into a mouthpiece, said inlet end portion is formed into a funnel shape with a flange and said inlet end portion is attached to said tobacco charge by the cigarette paper wrapping around the tobacco charge and the flanged funnel-shaped inlet portion.

9. The smoking device as claimed in claim 1 or 8 wherein said coiled tube is an activated charcoal cast core formed by a mold having two half sections.

10. The smoking device as claimed in claim 9 wherein said two half sections are cemented together with said activated core therein.

11. The smoking device as claimed in claim 9 further comprising a plastic sealant forming an impervious jacket around the activated charcoal core, said jacket forming the plastic tube.

12. The smoking device as claimed in claim 11, further comprising a section of thin wall plastic tube covering said core to protect the core from damage and to give the core structural strength, said plastic tube joined to said tobacco charge by cigarette paper wrapping.

13. The smoking device as claimed in claim 8, wherein the mouthpiece portion of the coiled tube is an integral part thereof.

14. The smoking device as claimed in claim 8 wherein said filter element is tapped with a "corkscrew" type thread to form said coiled helical passage.

15. The smoking device as claimed in claim 8, further comprising a cellulose filter and wherein said mouthpiece includes a stem, said cellulose filter is positioned between said outlet end portion and an inlet portion of said stem such that smoke travels from said tobacco charge through said coiled helical tube passage, said cellulose filter and then through said stem.

* * * * *